United States Patent [19]

Kritzler et al.

[11] 4,125,149

[45] Nov. 14, 1978

[54] HEAT EXCHANGE ELEMENTS

[75] Inventors: Gerhard Kritzler, Freudenberg; Siegfried H. Schluter; Paul Eckert, both of Wenden, all of Fed. Rep. of Germany

[73] Assignee: Apparatebau Rothemuhle Brandt & Kritzler, Fed. Rep. of Germany

[21] Appl. No.: 788,081

[22] Filed: Apr. 15, 1977

[30] Foreign Application Priority Data

Apr. 15, 1976 [DE] Fed. Rep. of Germany ..... 2616816

[51] Int. Cl.[2] ..... F28D 19/00

[52] U.S. Cl. ..... 165/10

[58] Field of Search ..... 165/8, 9, 10, 4

[56] References Cited

U.S. PATENT DOCUMENTS

| | | | |
|---|---|---|---|
| 3,183,963 | 5/1965 | Mondt | 165/10 |
| 3,554,273 | 1/1971 | Kritzler | 165/10 |

*Primary Examiner*—Albert W. Davis, Jr.

*Attorney, Agent, or Firm*—Watson, Leavenworth, Kelton & Taggart

[57] ABSTRACT

A heat exchange element for a rotary regenerative heat exchanger has corrugations of a wave-form conformation which include portions, extending between 10% and 50% of the wave length, which are parallel to the direction of flow of medium through the pack. Comparative data are given showing better efficiency in terms of heat-exchange effectiveness versus pressure loss than for apparently analogous prior art elements.

8 Claims, 9 Drawing Figures

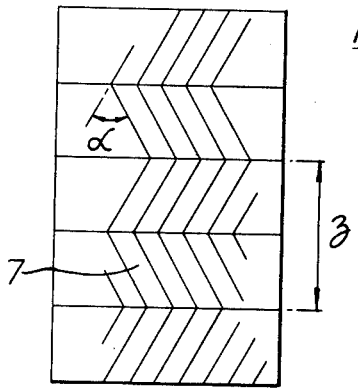
Fig. 2.
Fig. 3.
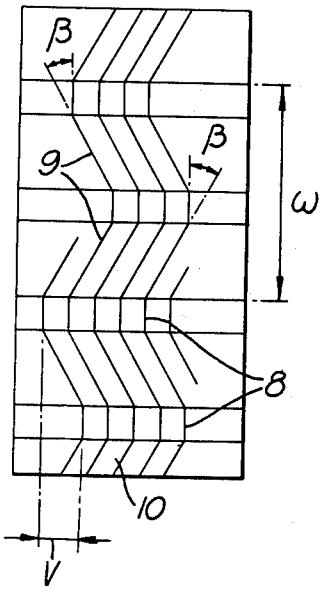
Fig. 4.
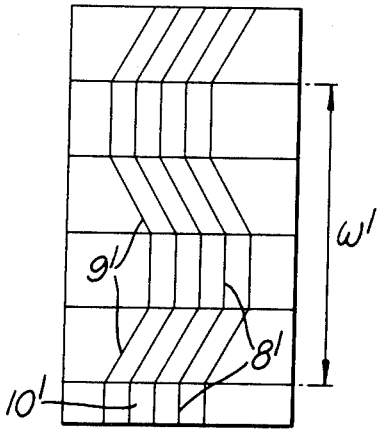

HEAT EXCHANGE ELEMENTS

FIELD OF THE INVENTION

This invention relates to heat exchange elements for rotary regenerative heat exchangers, and to rotary regenerative heat exchangers incorporating them.

BACKGROUND OF THE INVENTION

The design of heat exchange elements for rotary regenerative heat exchangers is a matter of great difficulty. On the one hand, high heat exchange between the solid element and the fluid medium is desired, and on the other, low pressure drop as the medium flows past the element is just as important, and conventionally advantage in heat exchange efficiency or in lack of pressure drop has been purchased at the cost of accepting less than ideal performance in the other respect.

In rotary regenerative air preheaters, the present standard practice is to increase heat-exchange efficiency by assembling a stack of elements between which the medium is to flow in which the elements are corrugated, with the corrugations of alternate elements running at equal but opposite angles to the direction of flow of the medium.

An example of this is seen in GBPS No. 1000496, which also suggests (FIG. 5) that an alternative conformation for each element would be a zig-zag.

The same idea is expressed, though in a form more efficient from the point of view both of pressure loss and of heat exchange, in GBPS No. 1439674, which was unpublished at the priority date of the present specification. This shows zig-zag corrugated elements sandwiching between them elements having a deeper and less frequent corrugation, with the channels formed by this second type of element running parallel to the direction of flow of the medium.

The sandwiching of elements of one type of conformaton between those of another type to build up a complex but efficient system of flow channels is in itself generally known and an arrangement described below with reference to FIG. 1 has been used for some years in rotary regenerative heat exchangers. This has straight-corrugated elements respectively oppositely angled to the direction of flow of the medium sandwiching an element of deeper and less frequent corrugations which extend along the direction of flow.

SUMMARY OF THE INVENTION

In the invention it is found most surprisingly that by adopting a conformation for elements which in many ways lies between a zig-zag and a straight corrugation, there are obtained results superior to both of those conformations, both in respect of heat exchange and in respect of pressure drop.

The present invention is characterised in that elements in a heat exchange pack for a rotary regenerative air preheater have corrugations of a wave-form conformation which (looking at the face of the element) include portions at the peak and trough of each wave which are parallel to the direction of flow of the medium (when the elements are arranged in the preheater) and linking portions at opposite inclinations. Such elements will usually be arranged in a pack to lie one each side of an element of a second type of element, the second type having a different corrugation depth. The second type will usually also have a different and greater wave length (seen in cross-section) between successive corrugations.

The portions parallel to the direction of flow in the first mentioned elements may be from about 10% to about 50%, more preferably 10% to 40% of the linear extent of the corrugations; and the amplitude (seen in face view) of the wave of each corrugation may be about equal to the wave length (seen in section) between adjacent corrugations.

Put alternatively the relationship between face view amplitude and face view wavelength will preferably be about 0.5, and suitably in the range 0.4 to 0.8.

A preferred wave length for the corrugations (seen in face view) will be between 100 and about 300 mm.

DESCRIPTION OF THE DRAWINGS

FIG. 2 is a plan view of a second prior art form of heat-exchange element, FIG. 3 is a plan view of a first embodiment of heat-exchange element according to this invention, FIG. 4 is a plan view of a second embodiment of heat exchange element according to this invention.

DESCRIPTION OF PREFERRED EMBODIMENTS

Figure 6:
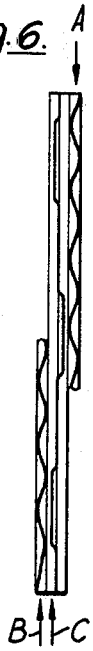
FIGS. 5 and 6 are end elevations of part of a heat exchange element pack as taken on arrows V and VI, respectively, of FIG. 1.
Figure 5:
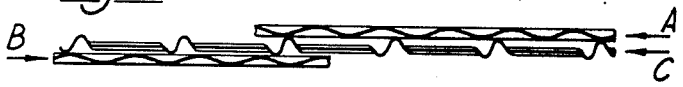
Figure 7:
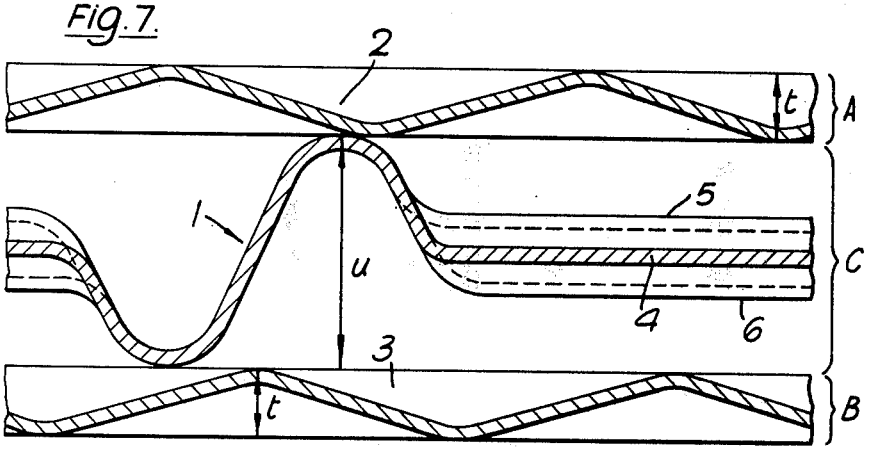
FIG. 7 is a much enlarged sectional elevation as taken on the line VII—VII, FIG. 1, but all of FIGS. 5, 6 and 7 being equally applicable to the prior art and to the embodiment of the invention.

As seen in FIGS. 5, 6 and 7 a pack of heat exchange elements for a rotary regenerative air preheater consists of two plate-like elements A, B sandwiching between them an element C of a second type. In a complete pack the sequence . . . ACBCAC . . . is repeated ad libitum to build up a desired total thickness for the pack, so that it may fit into the sectoral compartment of the regenerative support structure which is to receive it.

Elements A & B are of a type having shallow and comparatively short-wavelength corrugations, as seen in cross-section or edge view like in FIGS. 5 and 6; elements C are of a type having (in the same view) a deeper and longer-wavelength corrugation. Elements A & B may be identical to each other or different but, at least in the present discussion, will always have the corrugations extending at least partly at an angle to the direction of flow of medium through the pack, which is into or out of the plane of the paper in FIGS. 5 and 7 or along the plane of the paper in FIG. 6. The corrugations of elements C however are straight and parallel to that direction of flow.

In more detail, and as seen particularly in FIG. 7 the element C of sheet metal is rolled to have corrugations 1 which are straight in face (plan) view (FIG. 1) and which have in cross-section an amplitude greater than the amplitude of corrugations 2, 3 of the elements A & B.

Typically, the amplitude of corrugations 1 will be $1\frac{1}{2}$ times that of the corrugations 2 or 3. An uncorrugated web portion 4 spaces apart the corrugations 1. This web extends into elevated or depressed panels 5, 6 along its length.

Corrugations 2, 3 of elements A, B are of lesser wavelength (see in cross section) than the peak-to-peak distance between corrugations 1. Typically a peak-to-peak distance $x$ for corrugations 1 would be 2 $\frac{2}{3}$ the wavelength $y$ for corrugations 2 or 3 measured in a parallel cross-sectional direction. This gives a complex and labyrinthine preferred flow pattern for the medium through the pack.

In a first example of the prior art (FIG. 1), elements A and B had identical straight corrugations of a wavelength $y=15$ mm and amplitude $t=2.5$ mm set at identical cross-section, but respectively opposite angles to the direction of flow of medium. Elements C has a peak to peak distance between corrugations of 40 mm and an amplitude of 3.75 mm. In the graphs FIGS. 8 and 9 this example of prior art will be denoted H8.

In a second example of prior art (FIG. 2) elements A & B are both of zig-zag corrugated conformation 7. The cross section of the zig-zag is as in FIG. 7 with a cross-sectional amplitude of 2.5 mm and a cross-sectional wavelength of 15 mm, and they have a wavelength 3 in face view of 156 mm.

The angle $\alpha$ between successive legs of the zig-zag is 60°. A pack made up of these elements as elements A & B sandwiching elements C will be denoted in FIGS. 8 and 9 as H8F.

Elements embodying the invention are seen in FIGS. 3 and 4. Each is characterised by a corrugation 10, 10' wave-form in face view and which has portions 8, 8' extending parallel to the direction of flow of medium and portions 9, 9' linking them inclined at successively opposite but equal angles $\beta$, suitably about 30° and preferably within the range 20° to 40°, to that direction. The exact angle is governed by the cross-sectional wavelength of the corrugations by their face wavelength $w$, and by their face amplitude $v$.

A preferred amplitude $v$ is such that it equals their cross-sectional wavelength so that portions 8, 8' of adjacent corrugations are successively aligned in the direction of flow of the medium.

In FIG. 3 portions 8 occupy only about 30% of the face wavelength of the corrugations; in FIG. 4 portions 8' occupy $\frac{1}{2}$ of the face wavelength. The face wavelength $w$ of corrugations 10 is 220 mm of which 64 mm is occupied by portions 8; the face wavelength $w'$ of corrugations 10' is 312 mm of which half is occupied by portions 8'. The cross-section was as seen in FIG. 7 and cross-sectional amplitude and wavelengths are 2.5mm and 15 mm respectively (see FIGS. 5, 6 and 7.)

Figure 1:
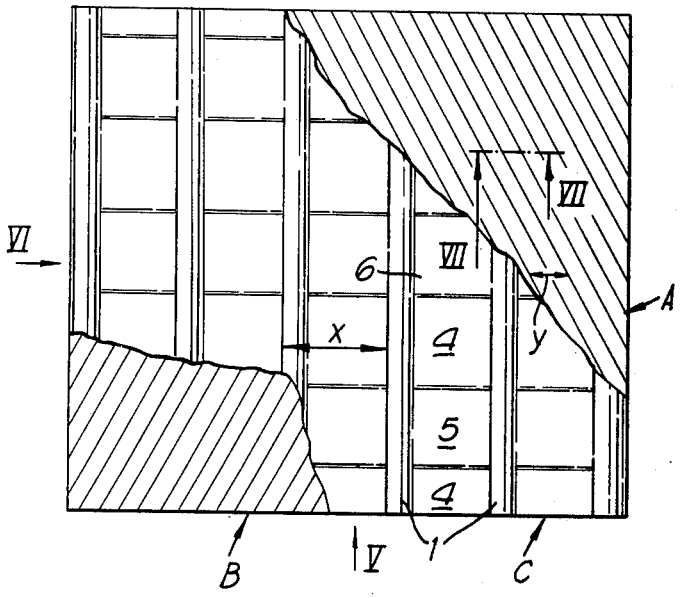
Fig. 1. PRIOR ART
FIG. 1 is a cut-away plan view of a prior art form of heat-exchanger element pack.

The pressure loss and heat-transfer characteristics of a heat-exchange plate pack embodying the invention, specifically that of FIG. 3, were compared with those of the prior art proposals seen in FIGS. 1 and 2. In the resulting graphs (FIGS. 8 and 9) the embodiment of the invention is denoted H8F''. Each pack listed was made up into an equal array of elements . . . ACBCACB . . . as seen in FIGS. 5, 6 and 7. It is of course an advantage of the forms of elements seen in FIGS. 3 and 4 (as well as FIG. 2) that they are all identical and symmetrical and may simply be stacked alternatingly with element C, whereas with packs such as seen in FIG. 1 elements A and B have to be deliberately laid in the appropriate alternating relationship.

Figure 8:
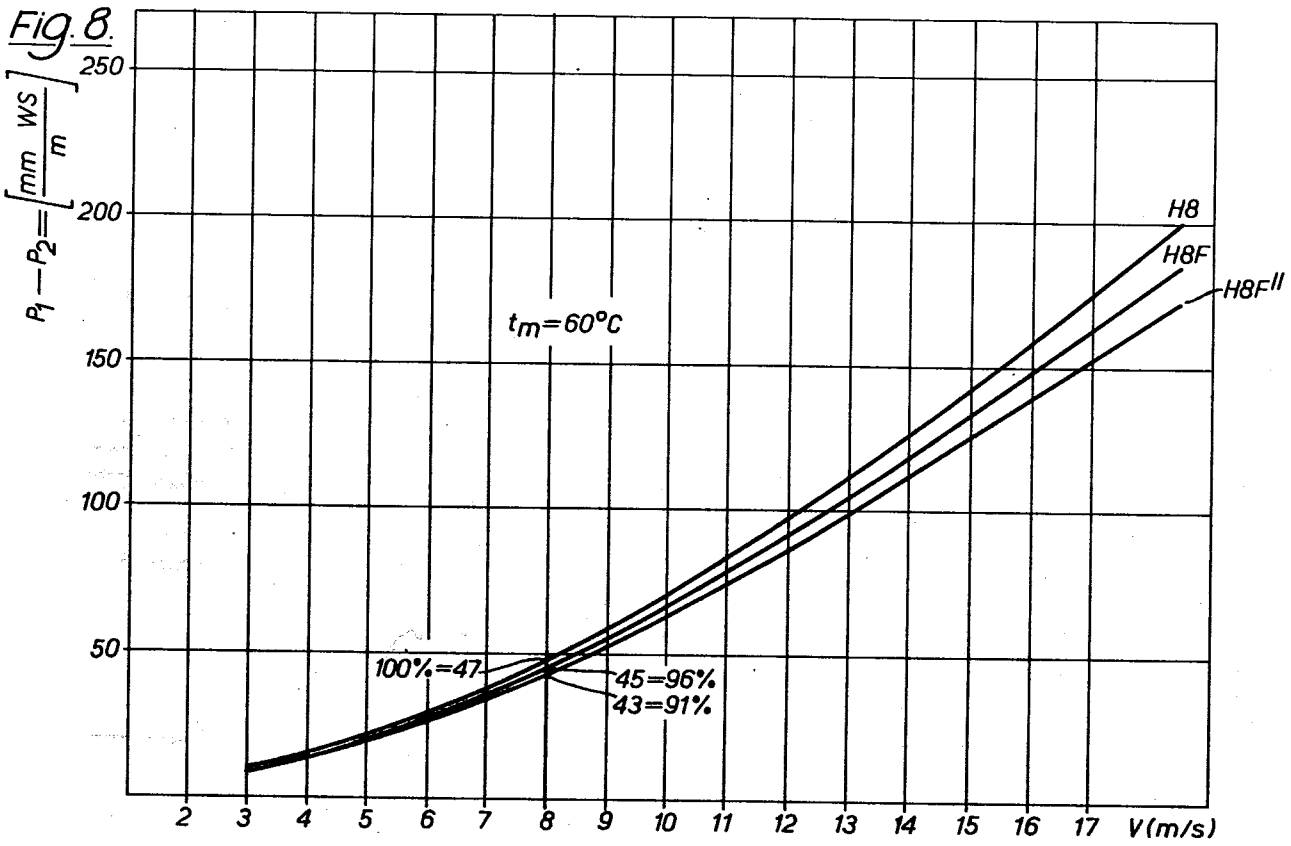
FIGS. 8 and 9 show comparative tests between the first and second prior art elements and that of the first embodiment of the invention, in respect of pressure loss and heat exchange efficiency, respectively, at various flow rates.

FIG. 8 shows pressure loss as a function of gas flow rate for prior art H8 and H8F and inventive H8F'' exchange packs. Taking pressure loss at 8 m/s gas flow for H8 as 100%, H8F is 96% (4% improvement) and H8F'' 91% (9% improvement).

Figure 9:
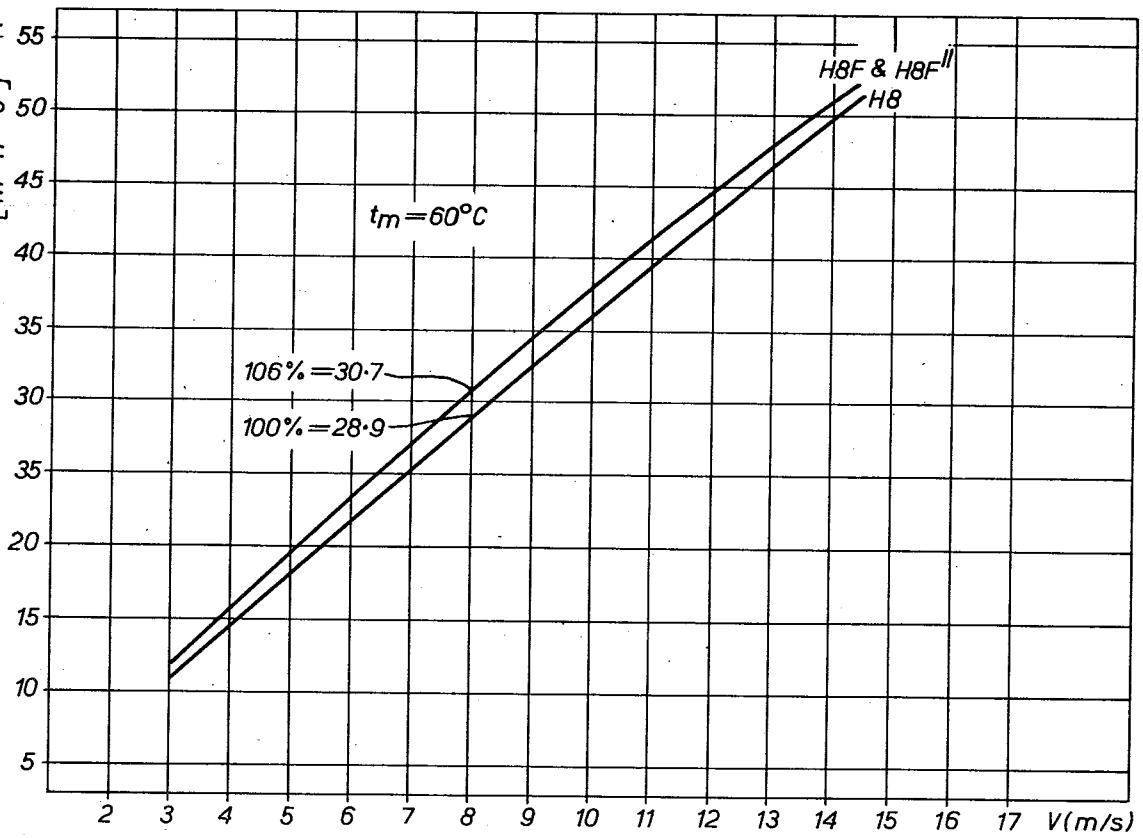

FIG. 9 shows heat-transfer efficiencies at different flow rates. H8F and H8F'' as good as each other but H8 is less efficient. At a flow rate of 8 m/s if H8 is taken to be 100% efficient, H8F and H8F'' are 108% efficient.

Both these general relationships are maintained to high flow rates.

It is surprising that H8F'' which in geometrical terms could be considered to lie conceptually between H8 and H8F is functionally superior to both and is in no way a compromise or half way house between them.

The manufacture of heat exchange elements such as in FIGS. 3 and 4 is preferably by a rolling process from sheet metal, the various portions 8, 9, 8', 9' of the corrugations 10, 10' being formed by respective appropriately toothed rings on the rolls. Transitions between parallel and linking portions of the wave-form need not be angular and preferably will be rounded off, so as to avoid excessive strain and hence fatigue during the forming process.

Apart from the ease of manufacture the principal advantage of the elements lies in their heat exchange efficiency coupled with low pressure loss due, it is believed, to high centrifugal forces and non-uniform flow generated in the medium as it flows along the corrugations encountering numerous changes of direction.

We claim:

1. In a heat exchange pack for a rotary regenerative air preheater designed for heat-exchange-medium flow therethrough in a predetermined direction, the improvement comprising a heat exchange element corrugated in a conformation which in face view is a wave-form including in the wave-form portions occupying about 10% to about 50% of the wave length of the wave-form, the said portions being parallel to the said direction.

2. In a heat exchange pack for a rotary regenerative air preheater designed for heat-exchange-medium flow therethrough in a predetermined direction, the improvement comprising a heat exchange element corrugated in a conformation which in face view is a wave-form including in the wave-form portions parallel to the said direction, the wave-form further including successively oppositely inclined portions alternating with the said parallel portions, the angle of inclination to the said direction of the said inclined portions being from about 20° to about 40°.

3. The improvement as claimed in claim 2 wherein the wavelength of the said wave-form is between 100 and 300 mm.

4. The improvement as claimed in claim 2 wherein the said portions occupy about $\frac{1}{3}$ of the wave length of the wave-form.

5. A heat exchange pack for a rotary regenerative air preheater designed for heat-exchange-medium flow therethrough in a predetermined direction and comprising alternately elements of a first type and elements of a second type;

said elements of the first type being corrugated in a conformation which in face view is a wave-form including in the wave-form portions parallel to the said direction; and said elements of the second type having straight corrugations of different cross-sectional amplitude from the said wave-form corrugations of the said elements of the first type, the said straight corrugations extending parallel to the said directions.

6. A heat exchange pack as claimed in claim 5 wherein the cross-sectional amplitude of the said straight corrugations is about 1-½ times that of the said wave-form corrugations.

7. A heat exchange pack as claimed in claim 5 wherein all the elements of the said second type are identical with each other and are positioned identically above each other in the pack.

8. The improvement as claimed in claim 5 wherein the straight corrugations are of different cross-sectional wavelength from the said wave-form comformation corrugations.

* * * * *